US006283321B1

(12) United States Patent
Meshorer

(10) Patent No.: US 6,283,321 B1
(45) Date of Patent: Sep. 4, 2001

(54) WASTE RECEPTACLE

(75) Inventor: Yshai Meshorer, Tel Aviv (IL)

(73) Assignee: Zag Industries Ltd., Rosh Ha'Ayin (IL)

( * ) Notice: Subject to any disclaimer, the term of this patent is extended or adjusted under 35 U.S.C. 154(b) by 0 days.

(21) Appl. No.: 09/635,399

(22) Filed: Aug. 10, 2000

Related U.S. Application Data

(60) Provisional application No. 60/148,651, filed on Aug. 13, 1999.

(51) Int. Cl.[7] ..... B65F 1/06

(52) U.S. Cl. ..... 220/495.07; 220/908.1; 220/4.22

(58) Field of Search ..... 220/495.07, 908.1, 220/404, 909, 4.22

(56) References Cited

U.S. PATENT DOCUMENTS

| | | | | |
|---|---|---|---|---|
| 3,063,591 | | 5/1962 | Laginestra . | |
| 3,195,272 | | 7/1965 | Mosher et al. . | |
| 3,800,503 | * | 4/1974 | Maki | 220/495.07 |
| 5,031,793 | * | 7/1991 | Chen et al. | 220/495.07 |
| 5,881,900 | * | 3/1999 | Meshorer | 220/495.07 |
| 6,126,031 | * | 10/2000 | Reason | 220/495.07 |

* cited by examiner

*Primary Examiner*—Joseph M. Moy
(74) *Attorney, Agent, or Firm*—Pillsbury Winthrop LLP

(57) ABSTRACT

A waste receptacle comprises two hinged sectional parts and a bag compartment at the bottom portion of the sectional parts to receive and to provide access to a roll of bags.

9 Claims, 10 Drawing Sheets

WASTE RECEPTACLE

This application claims priority from U.S. Provisional Patent Application Ser. No. 60/148,651, filed Aug. 13, 1999, the contents of which are incorporated by reference herein in their entirety.

FIELD OF THE INVENTION

The present invention is generally related to waste receptacles and is more particularly related to a waste receptacle having a bag storage compartment therein and separable receptacle walls that facilitate access to the bags stored in the storage compartment.

BACKGROUND OF THE INVENTION

A wide variety of waste receptacles are commercially available. Waste receptacles can range in size from about one liter up to the approximately 215 liters (approximately 56-gallons). Plastic bags are often used to line the waste receiving space in a waste receptacle, particularly if the waste disposed in the receptacle is moist, such as kitchen waste, or is contaminated or hazardous, such as hospital waste. Most plastic liner bags are made of polyethylene or polyethylene. Plastic bags are often provided to the end user as a continuous roll of bags. Each bag in a particular roll has a leading open end and a sealed end that is removably secured to the open end of the next succeeding bag in the roll.

Because bags are usually not reused, they are replaced each time the receptacle is emptied. It is desirable to store a supply of new bags at the location of the waste receptacle so that a new bag is readily available when the receptacle is emptied. It is also desirable to be able to quickly and easily remove a new bag from the supply of bags in the storage area and place it in the waste during the bag replacement procedure.

Bag dispensers that are located in waste receptacles are known. For instance, U.S. Pat. No. 5,881,900, describes a waste receptacle that contains a space for storing and dispensing new bags for lining the receptacle in the base of the receptacle. While such a receptacle alleviates the problem of finding a new liner bag, it does not satisfactorily provide ease of access to a new liner bag nor does it adequately address the difficulty of removing a full bag of waste from the receptacle.

There is a need for a waste receptacle having a receptacle portion that can be easily opened to facilitate removal of a full bag of waste and having a bag storage space constructed and arranged to supply a new bag in the receptacle when a full bag is removed.

SUMMARY OF THE INVENTION

It is an objective of the present invention to improve upon the aforementioned waste receptacles by providing a waste receptacle for use in conjunction with a roll of bags. The waste receptacle is constructed and arranged to facilitate the removal of a full bag of waste and to provide ready access to a supply of new bags for lining the receptacle. Accordingly, the present invention provides a waste receptacle having a base constructed and arranged to support the receptacle in an upright position on a ground surface. The base has a bag storage space with a generally upwardly facing access opening. The bag storage space is constructed and arranged so that the roll of bags can be stored therein and accessed through the access opening. The waste receptacle further includes a first receptacle member and a second receptacle member providing first and second peripheral wall portions, respectively, and first and second interior bottom wall portions, respectively. The first and second receptacle members are movable relative to one another between 1) a normal, operative position and 2) a bag roll changing position. In the normal operative position, the first and second peripheral wall portions of the waste receptacle cooperate to provide the receptacle with a peripheral wall that extends generally upwardly from the base, and the first and second bottom interior wall portions cooperate to provide the receptacle with a bag supporting bottom wall that supports the bottom of a deployed bag within the receptacle. The first and second bottom interior wall portions together with the first and second peripheral wall portions define a waste receiving space. An upper edge portion of the first and second peripheral wall portions define a waste receiving opening that affords entry to the waste receiving space. In the bag roll changing position, the first and second receptacle members are moved apart from one another so as to increase the size of the waste receiving opening to facilitate access to the bag receiving space through the upwardly facing access opening so that a new roll of bags can be placed within the bag receiving space.

Other objects, features, and advantages of the present invention will become apparent from the following detailed description, the accompanying drawings, and the appended claims.

DETAILED DESCRIPTION OF THE PREFERRED EMBODIMENT

Figure 1:
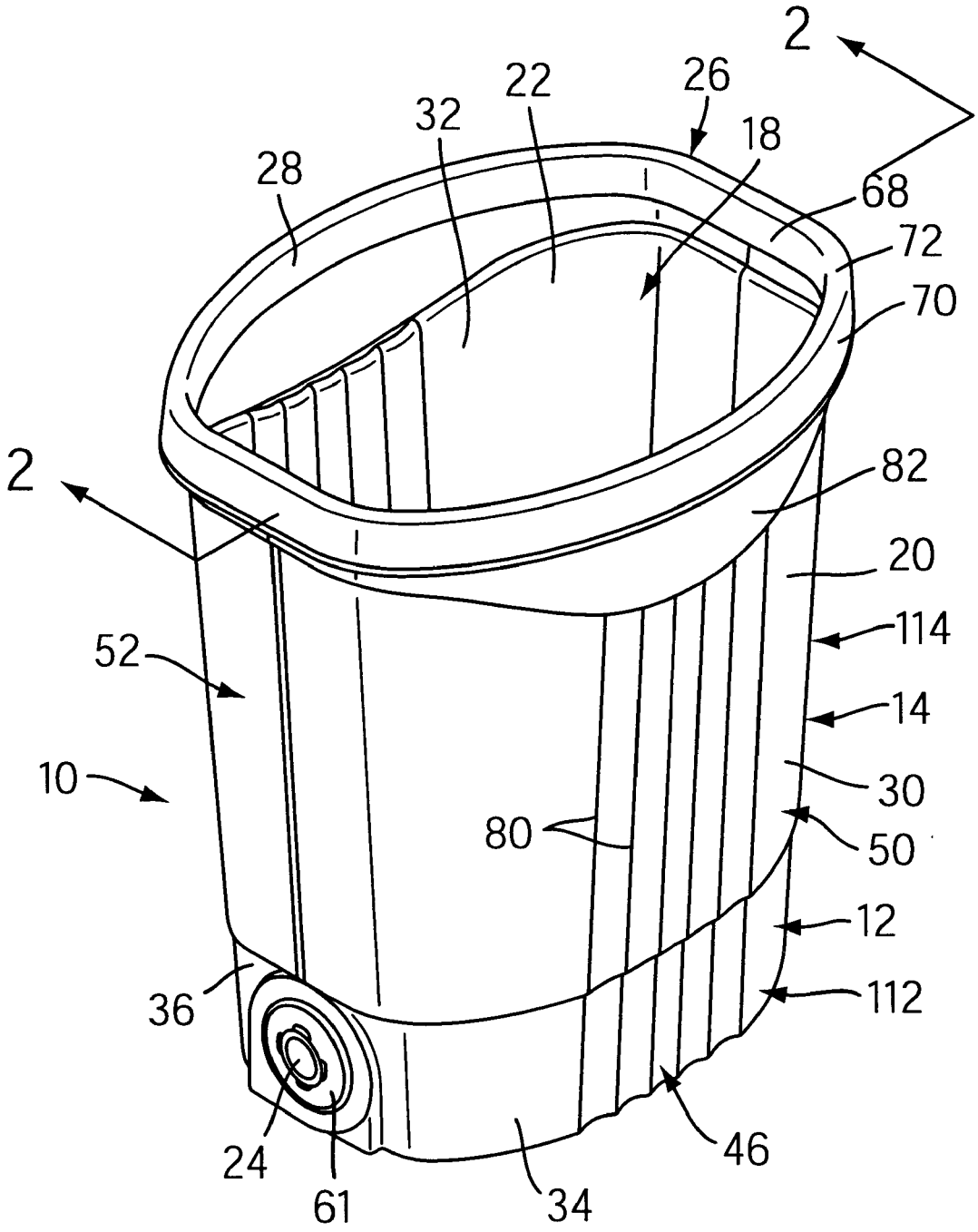
FIG. 1 is a perspective view of a waste receptacle constructed according to the principles of the present invention.

FIG. 1 shows a waste receptacle, generally designated 10, constructed according to the principles of the present invention. The waste receptacle 10 generally includes a base 12 that is constructed and arranged to contain a roll of receptacle liner bags and a peripheral wall 15 that extends generally upwardly from the base 12 to form a receptacle structure or portion 14 that is supported by the base 12. The receptacle portion 14 is constructed and arranged to hold and support a plastic liner bag to receive waste.

Figure 2:
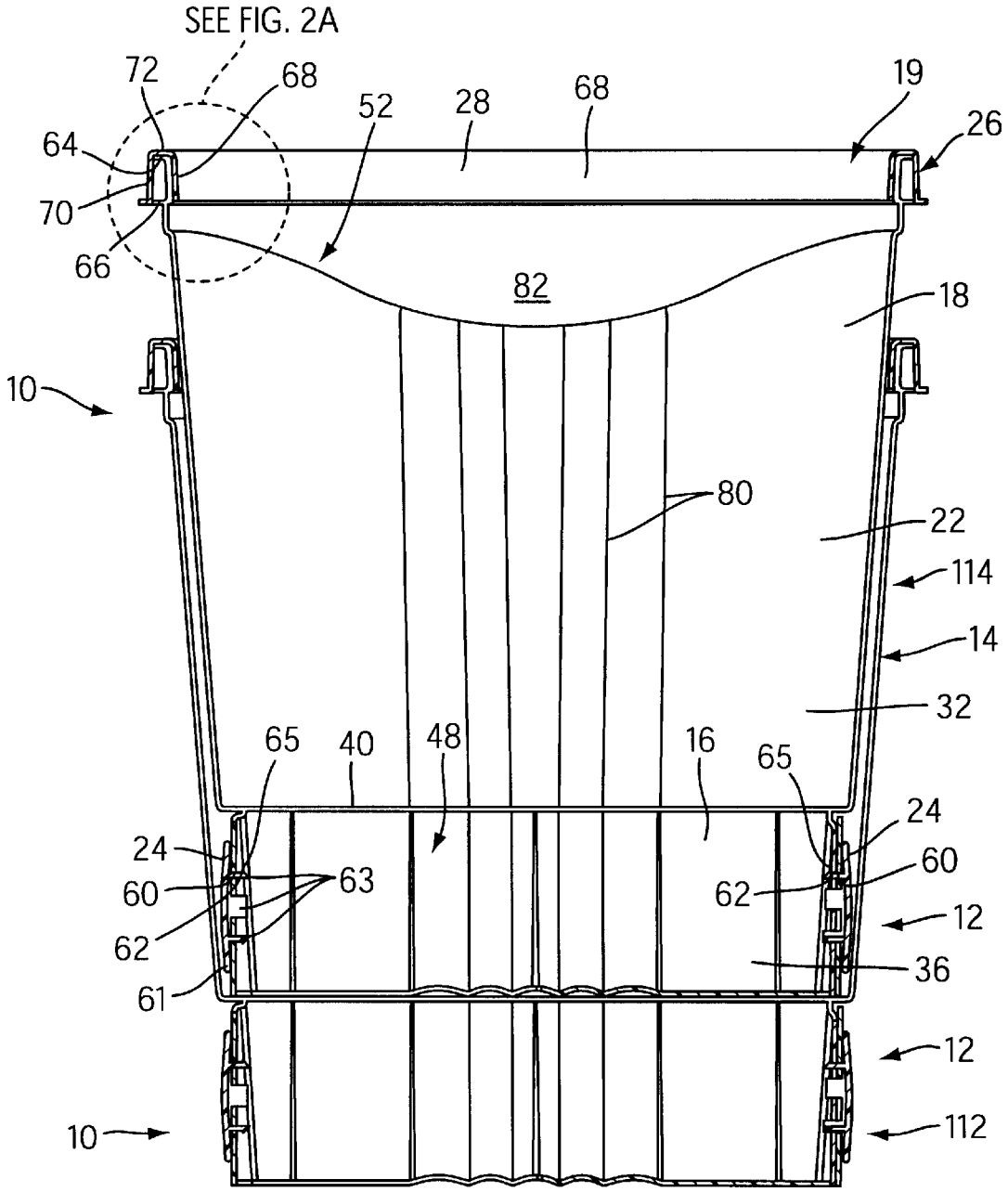
FIG. 2 is a cross sectional view of two nested assemblies taken generally through the line 2—2 of FIG. 1.

The construction and arrangement of the base 12 and the receptacle portion 14 can be appreciated from the cross-sectional view of FIG. 2. The base 12 includes a bag storage space 16 to hold a supply of rolled liner bags (not shown in FIG. 2) and the receptacle portion 14 is constructed and arranged to receive a succession of bags from the supply of bags in the bag storage space 16 and hold each bag in a bag supporting and waste receiving space 18 provided in the receptacle portion 14. Generally, a leading bag in a roll of bags is mounted to line the interior of the receptacle portion 14 and to receive waste through a waste receiving opening 19 in the receptacle portion 14. When the bag is full of waste, it is removed from the waste receptacle 10 and a new bag is supplied to the receptacle portion 14 from the bag storage space 16.

The waste receptacle 10 is generally comprised of a pair of receptacle members 20, 22 that cooperate to form the base 12 and the receptacle portion 14 of the waste receptacle 10. Preferably, the receptacle members 20, 22 are integral structures made of a suitable molded plastic. Preferably the receptacle members 20, 22 are of identical construction. The receptacle members 20, 22 and the portions thereof are given different reference numbers to facilitate discussion of the invention only and does not imply structural differences.

The receptacle members 20, 22 are rotatably mounted together by a pair of identical end pieces or end cap connector members 24 for movement between 1) a closed normal operative position wherein a bag is supported in the receptacle portion 14 to receive waste (see FIG. 1, for example, although a bag is not shown in the receptacle portion 14 to more clearly illustrate the waste receptacle 10) and 2) an open access and bag roll changing position (see FIGS. 4 and 5) in which the base 12 is open so that the bag storage space 16 is accessible to place a supply of bags therein and in which the receptacle portion 14 is open and the waste receiving opening is increased in size to provide greater access to the interior of the receptacle portion 14 of the waste receptacle to facilitate, for example, removal of a full bag of waste.

The structure of the of the receptacle members 20, 22 can be best appreciated from FIGS. 2, 4, 5 and 5A. Each integral receptacle member 20, 22 includes peripheral receptacle wall portions 30, 32 respectively, and peripheral base wall portions 34, 36, respectively. Each receptacle member 20, 22 includes a respective interior bottom wall portions 38, 40. The peripheral receptacle wall members 30, 32 extend generally upwardly from the base 12 and define the sides of the waste receiving space 18 when the waste receptacle 10 is in its operative position. The interior bottom wall portions 38, 40 extend generally laterally from the receptacle wall portions and interengage to form a bag supporting floor surface of the receptacle portion 14 when the waste receptacle 10 is in its closed position.

The peripheral base wall portions 34, 36 of the receptacle members 20, 22, respectively, cooperate when the waste receptacle 10 is in its closed position to define the sides of the base 12. An exterior bottom wall portion 42, 44 extends generally laterally from a bottom edge of a respective base wall portion 34, 36. The interior surfaces of the exterior bottom wall portions 42, 44 cooperate to form the bottom floor surface of the base 12 of the receptacle waste receptacle 10 and the exterior surfaces of the bottom wall portions 42, 44 cooperate to form the exterior bottom surface 37 (see FIG. 1A, for example) of the waste receptacle 10 when the waste receptacle is in its closed position. The exterior bottom wall portions 42, 44 are spaced slightly apart (see FIG. 1A) when the waste receptacle 10 is in its closed operative position to allow relative pivotal movement between the receptacle members 20, 22 about the pivot end pieces 24 to the bag changing position.

The waste receptacle 10 also includes a releasable connector or holding member 26 that is 1) mountable on the receptacle members 20, 22 to secure the wall portions 30, 32 together (see FIG. 1) to hold the same in their normal operative position and to hold open a bag in the receptacle portion 14 and 2) to be removable from the receptacle members 20, 22 (see, for example, FIG. 3) to allow the same to be moved to their bag changing position. In the exemplary embodiment of the waste receptacle 10, the holding member 26 is in the form of a peripheral ring 28 that is an integral structure, preferably constructed of a suitable molded plastic.

Figure 4:
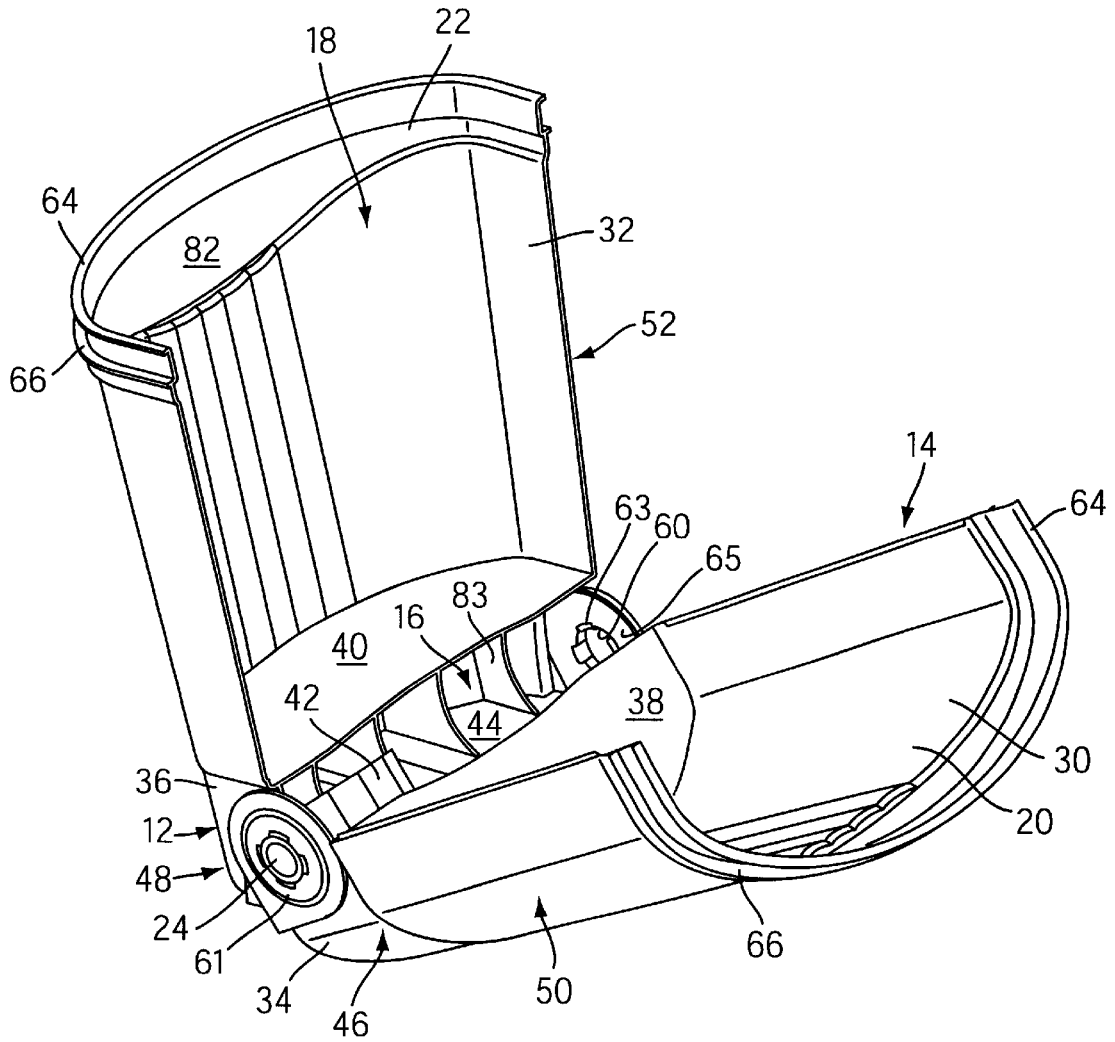
FIG. 4 is a perspective view of the waste receptacle in its open access position and with the peripheral ring removed and not to shown.
Figure 5:
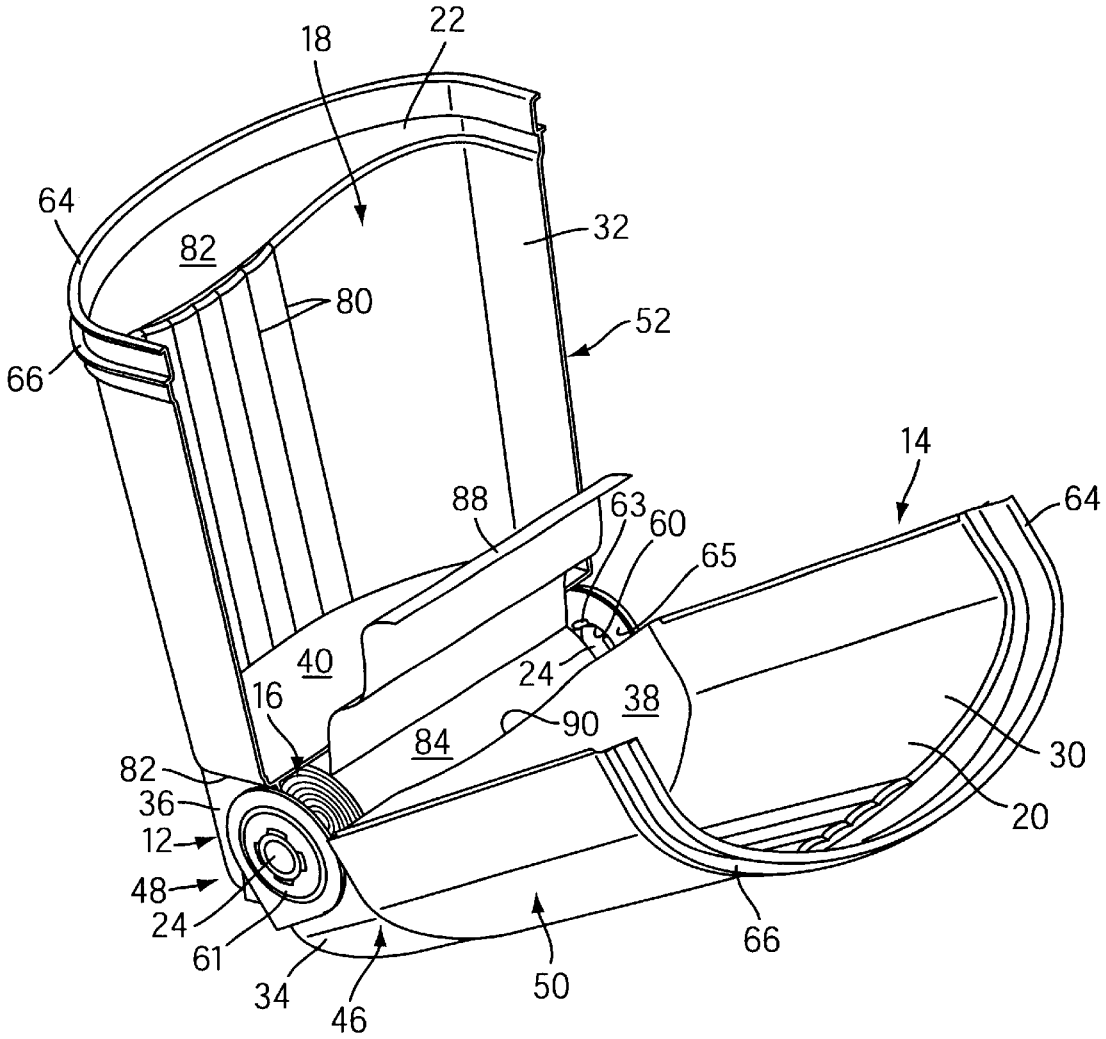
FIG. 5 is a view similar to FIG. 4 except showing a supply of bags in a base of the waste receptacle.
Figure 5A:
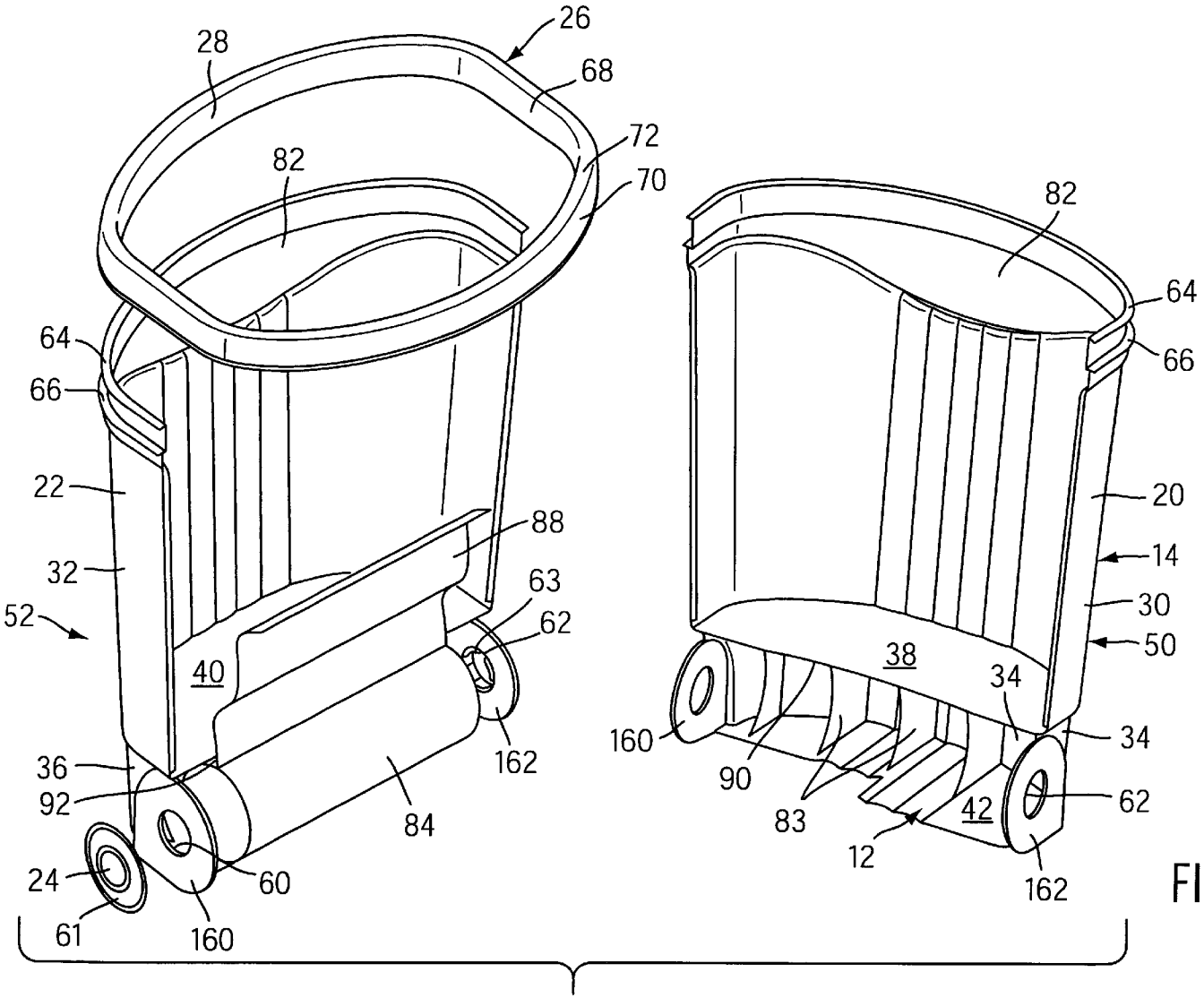
FIG. 5A is a partially exploded view of the waste receptacle with a roll of bags disposed therein.

It can be appreciated from FIG. 4 that each receptacle member 20, 22 provides part of the base 12 so that the base 12 is separable into two parts, generally designated 46, 48 respectively. The base parts 46, 48 are rotatably joined together by the end pieces 24. Similarly, each receptacle member 20, 22 provides part of the receptacle portion 14 so that the receptacle portion 14 is separable into two parts, generally designated 50, 52, respectively. It can be understood from FIG. 4 that in one preferred embodiment of the waste receptacle 10, the base part 46 is integrally formed with receptacle part 50 to form the integral receptacle member 20, preferably the parts 46, 50 being formed to in a single molding step. Preferably base part 48 and receptacle part 52 of receptacle member 22 have identical constructions to the base part 46 and the receptacle part 50, respectively.

It can also be appreciated from FIG. 4 that, in essence, the entire waste receptacle 10 is formed from two major half components (i.e. the receptacle members 20, 22), each member 20, 22 preferably being an integral structure molded from a plastic material. Preferably each receptacle member 20, 22 is molded in a single molding step. The two portions 20, 22 are pivotally connected towards the bottom ends thereof (by the end pieces 24 in a manner described below) for movement between opened and closed positions as aforesaid, and releasably secured together in the operative position by the peripheral ring 12 towards the upper ends thereof.

It can also be the appreciated (from FIGS. 4, 6 and 7 in particular) that the receptacle members 20, 22 are identical molded structures that can be, for example, made using the same mold cavity. The two members 20, 22 and portions thereof are given different reference numerals to more clearly describe the invention and because it is within the scope of the invention to provide to waste receptacle that is constructed of two mating receptacle members that are movably mounted for movement between opened and closed positions as aforesaid, but which mating receptacle members are not identical. It can be understood that it is preferred that the receptacle members 20, 22 be identical to simplify the manufacturing process. Thus the exemplary embodiment of the waste receptacle 10 shows that a waste receptacle can be constructed using two identical mating receptacle members 20, 22, two identical end pieces or end cap connector members 24 and a peripheral ring 12.

Figure 1A:
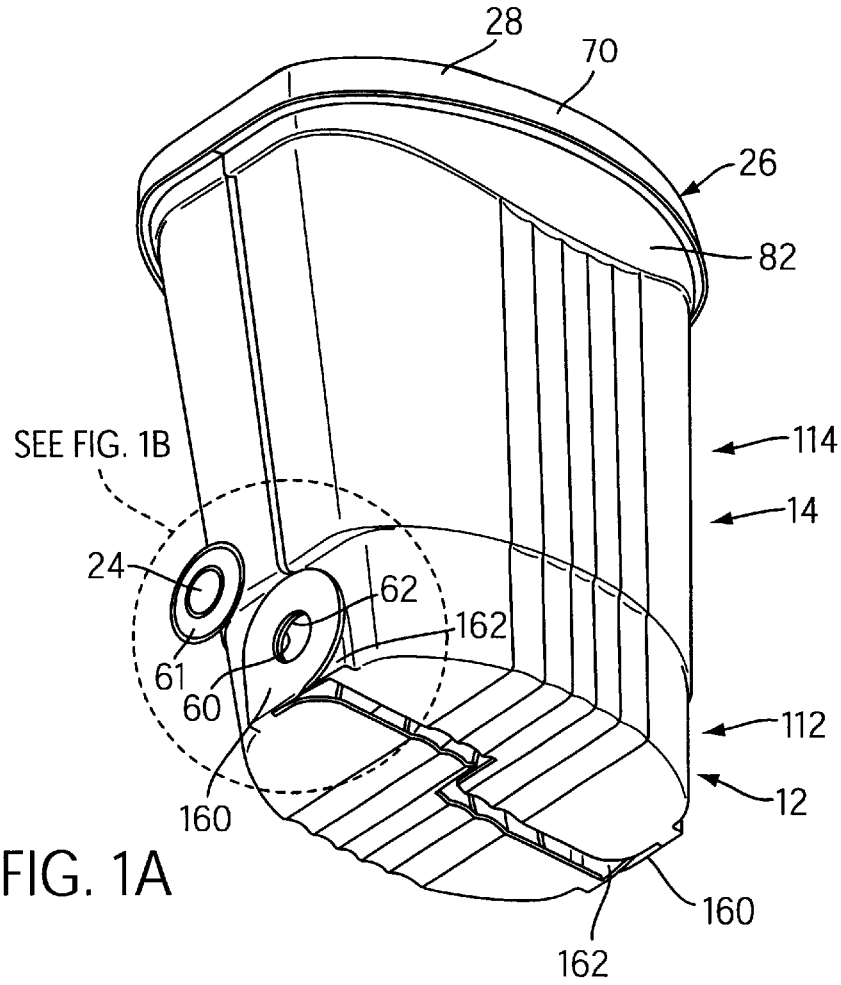
FIG. 1A is a perspective view of a bottom of the waste receptacle of FIG. 1 showing an end cap connector member thereof in exploded relation to the waste receptacle.
Figure 1B:
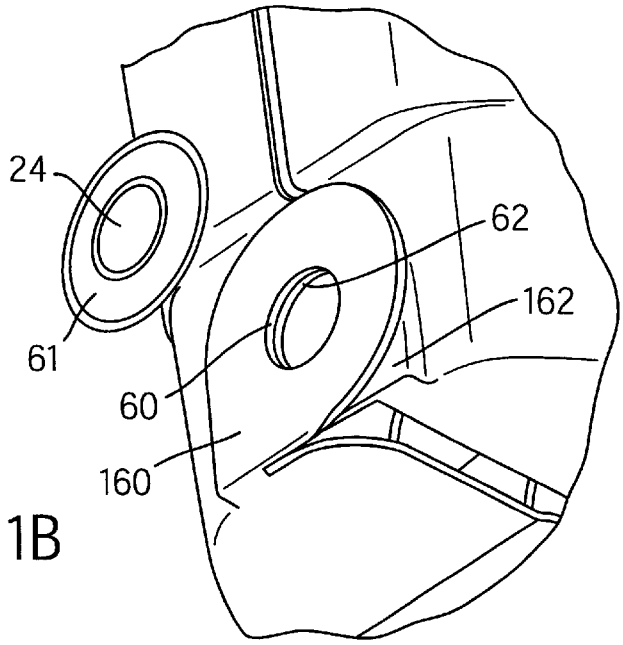
FIG. 1B shows an enlarged view of a portion of the waste receptacle as indicated in FIG. 1A.

The pivotal mounting of the receptacle members 20, 22 can best be appreciated from the partially exploded view of FIGS. 1A and 1B and from the cross sectional view of the FIG. 2. The receptacle members 20, 22 are pivotally connected to together by the end cap connector members 24 which extend through apertures 60, 62 formed in respective abutting and overlapping outwardly extending portions 160, 162, respectively, formed on opposite ends of each peripheral base wall portions 34, 36. It can be appreciated from FIGS. 1A and 1B, for example, that the outwardly extending wall portion 160 on each base wall portion 34 (or 36) is pivotally mounted to the outwardly extending wall portion 162 on the other base wall portion 36 (or 34) and that each wall portion 160 is disposed outwardly of the wall portion 162 with which it is paired.

The structure of the end cap connector members 24 can be best understood from FIGS. 2 and 4. Each end cap connector member 24 is an integral plastic structure that includes a thin disk-shaped body portion 61 and a plurality of integral plastic outwardly extending legs 63. The legs 63 are constructed and arranged to extend through the apertures of the abutting overlapping peripheral base wall portions 34, 36 and hookingly, lockingly engage a wall surface 65 surrounding the innermost aperture. Each end cap connector member 24 can press fit into the aligned apertures 60, 62 to pivotally secure the receptacle members 20, 22 together.

Figure 2A:
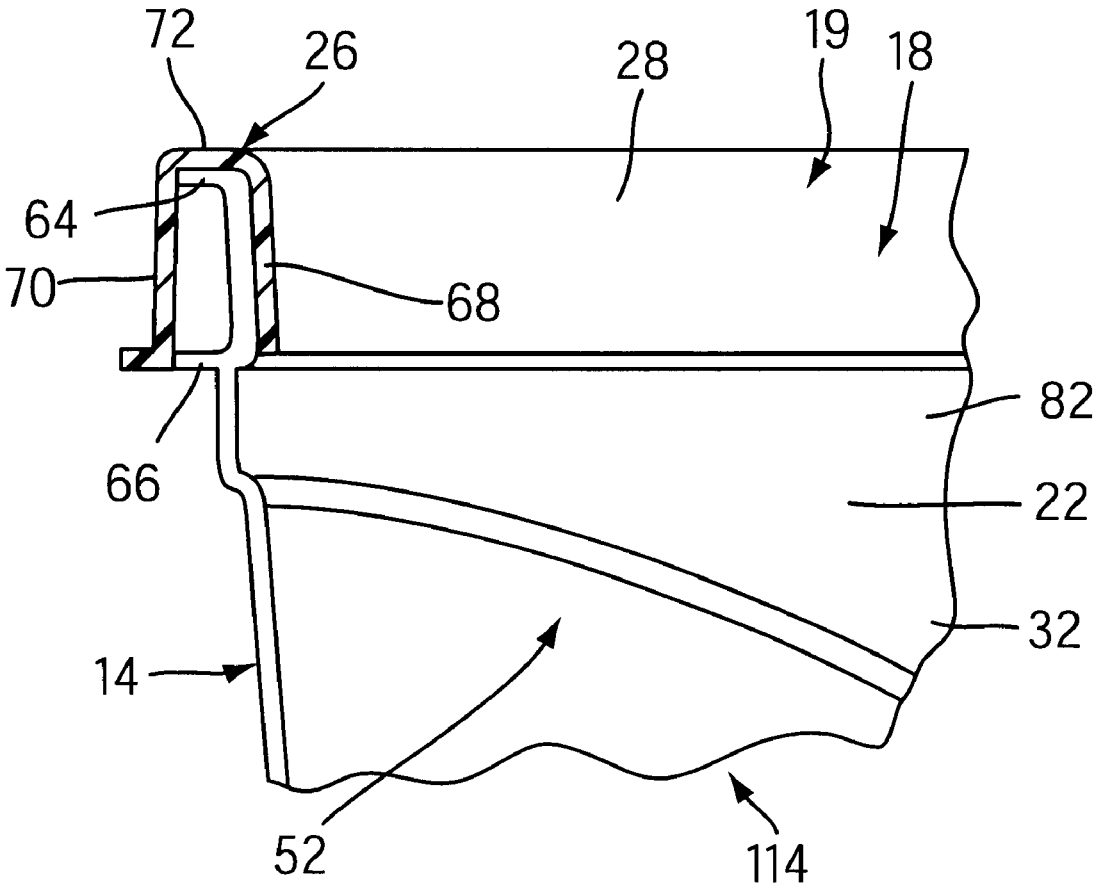
FIG. 2A shows an enlarged portion of the cross sectional view as indicated in FIG. 2.
Figure 3:
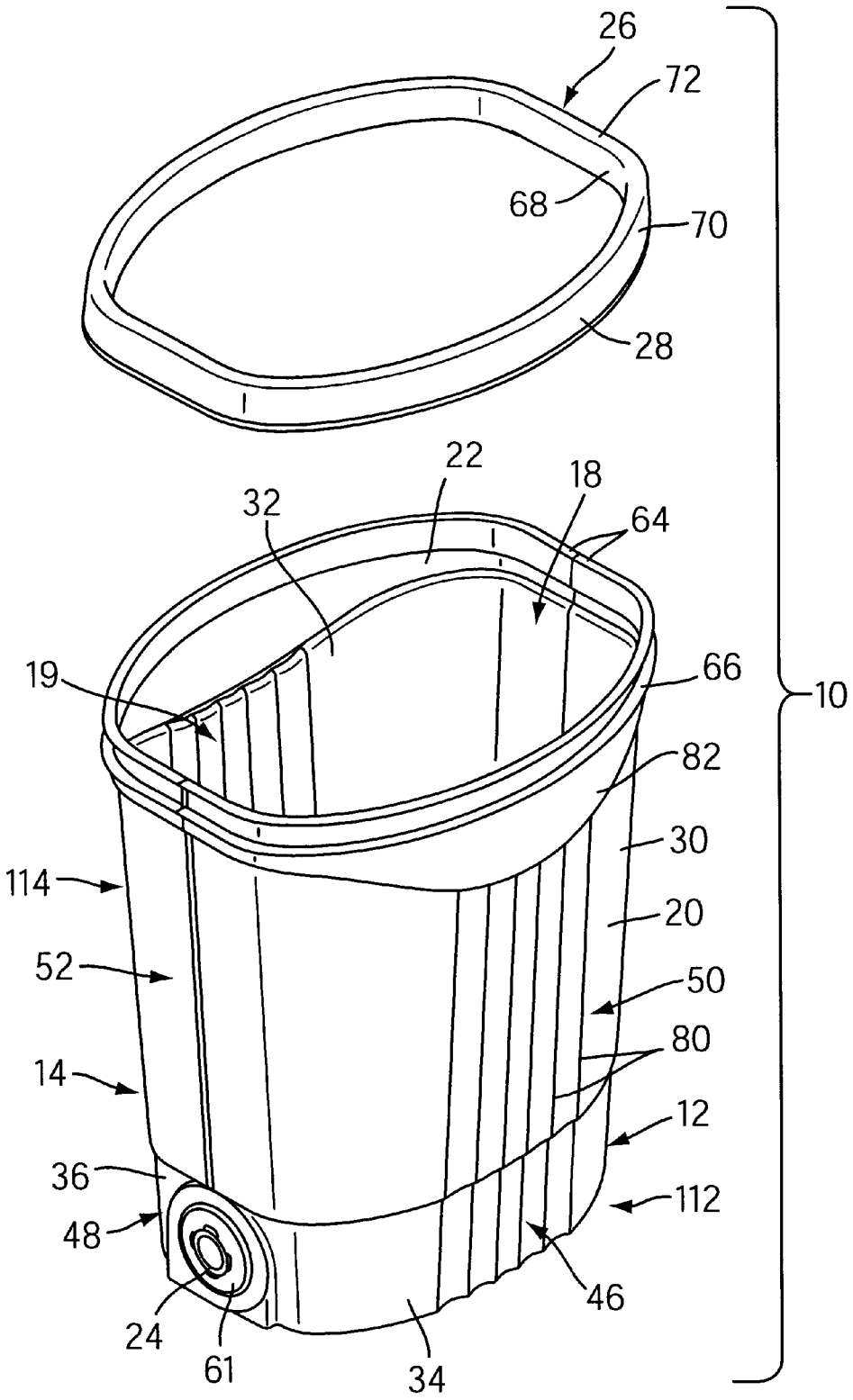
FIG. 3 is a perspective view of the waste receptacle similar to the view of FIG. 1 except showing a peripheral ring of the waste receptacle in exploded view.

It can also be appreciated from FIG. 3, for example, that the upper edges of the peripheral receptacle wall portions 30, 32 define the waste receiving opening 19. It can be understood from the cross-sectional views of FIGS. 2 and 2A that the peripheral receptacle wall portions 30 (not shown in FIGS. 2 and 2A), 32 also cooperate to define a first flange 64 projecting radially outwardly, away from the interior waste receiving space 18. A second, concentric flange 66 is located below and substantially parallel to the first, outwardly projecting flange 64 and circumferentially surrounds the peripheral wall portions 30, 32 (in the closed position of the receptacle 10). The peripheral ring 28, preferably has inner and outer side walls, 68 and 70, respectively, connected by an upper wall 72. The ring 28 preferably has an interior channel 74 therethrough defined by the walls, 68, 70, 72, and which is opened along the underside of the ring 28.

Thus, the peripheral ring 28 can receive the upper edges of the peripheral receptacle wall portions 30, 32 of the receptacle members 20, 22, respectively, in the closed operative position, with the upper wall 72 resting on the flange 64 and/or with the bottom end of the wall 72 resting on the flange 66. The peripheral receptacle wall portions 30, 32 and the peripheral base wall portions 34, 36 optionally have a plurality of vertically disposed wall-strengthening ribs 80 molded therein. The peripheral receptacle wall portions 30, 32 are circumferentially reinforced by a wall strengthening girdle 82 located immediately below and adjacent to the second flange 66.

FIG. 1 shows the waste receptacle 10 with the peripheral ring 28 securing the receptacle members 20, 22 in their closed, operative position. The peripheral ring 28 is placed over the first and second flanges 64, 66 (see FIG. 2A, for example) and the upper wall 72 of the peripheral ring 28 rests on the upper edges of the peripheral receptacle wall portions 30, 32.

The receptacle members 20, 22, the peripheral ring 28 and the end cap members 24 may be molded of polyethylene, polypropylene, or a similar material. For large sized waste receptacles, a structural plastic foam is preferable. Preferably, embodiments of the waste receptacle constructed for outdoor use are made substantially of metal, or a plastic that contains an ultraviolet stabilizer, thereby protecting the plastic against ultraviolet light degradation, wherein the word "substantially" implies that most elements of the waste receptacle are made of metal or the aforementioned plastic variants.

Figure 7:
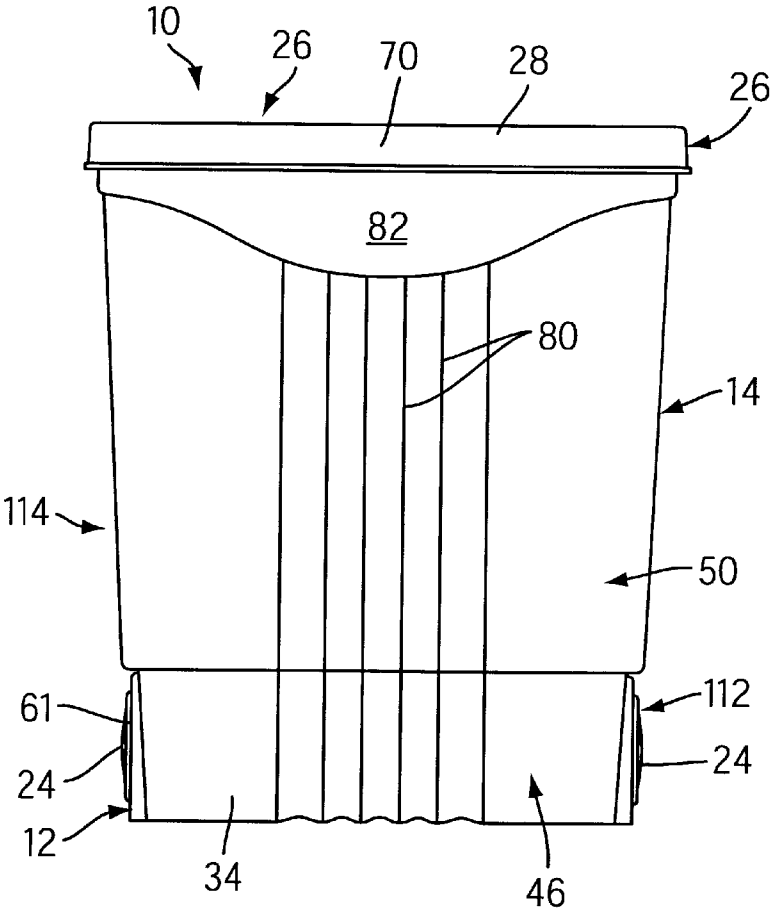
FIG. 7 as a front elevational view of the waste receptacle.
Figure 6:
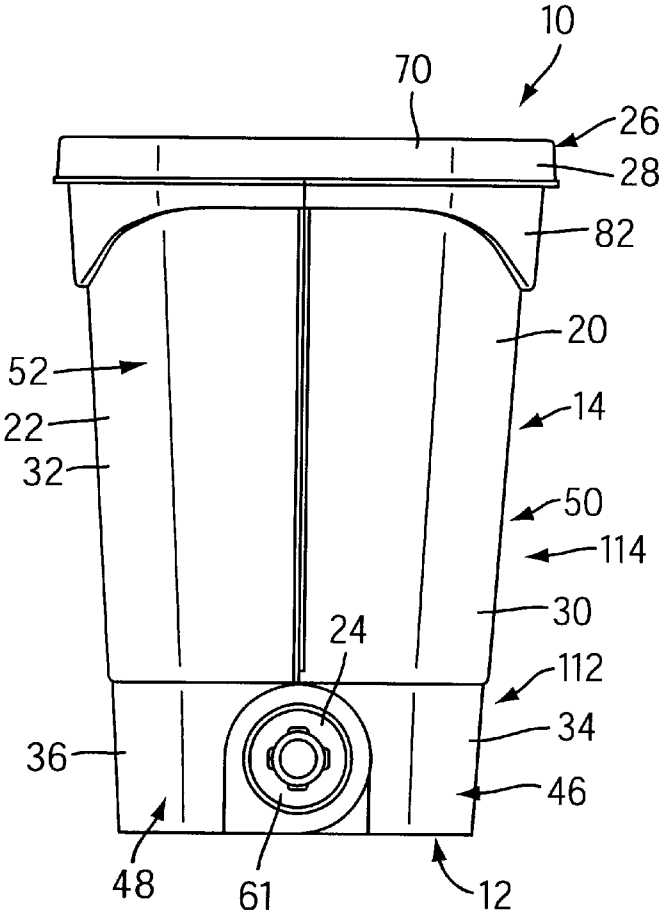
FIG. 6 is a side elevational view of the waste receptacle.

FIGS. 6 and 7 are elevational views showing the sides and front, respectively, of the waste receptacle 10 with the peripheral ring 28 in place.

Operation

The operation of the waste receptacle 10 to be best understood from an examination of FIGS. 1, 3–5. FIG. 1 shows the waste receptacle 10 in its closed normal operative position. To place a supply of bags in the waste receptacle 10 the user removes the peripheral ring 28 (see FIG. 3, for example) and moves the receptacle members 20, 22 about the end cap connector members 24 from their closed normal operative position to their open access and bag roll changing position (see FIG. 4). The pivotal movement of at least one of the receptacle members 20, 22 toward and into the open position moves at least one of the interior bottom wall portions 38 or 40, thereby separating the interior bottom wall portions 38, 40 to provide access to the bag storage space 16 of the base 12. The bag storage space 16 of the base 12 optionally includes a plurality of integral, spaced wedges embodied in the form of a plurality of support ribs 80 (see FIG. 5A, for example) and optionally includes a spool (not shown because it is not part of the exemplary embodiment 10) to facilitate the dispensing of a roll of plastic liner bags.

When the waste receptacle 10 is in its open access position, the user can place a new roll of plastic bags 84 in the bag storage space 16. The roll of plastic bags 84 are preferably held in place and supported for rotational movement within the bag storage space 16 by the support ribs 80 (see FIGS. 4 and 5A). The waste receptacle user pulls the leading bag 88 on the role of bags 84 upwardly through the separated interior wall portions 38, 40 so that the length of the leading bag extends tangentially outwardly from the roll 84 and the bottom of the leading bag in the roll 84 is immediately adjacent to roll 84 or spaced slightly therefrom. The user then moves the first and second receptacle members 20, 22 back into their normal closed operative position.

The bags are disposed on the roll 84 such that the open end of the leading bag 88 is at the leading edge of the roll 84 and such that the sealed end of the leading bag 88 is still connected to the following bag on the roll 84. Therefore a user can line the receptacle portion 14 of the waste receptacle 10 with the leading bag 88 while the sealed end of the leading bag 88 is still attached to the next bag on the roll 84.

To line the receptacle with the leading bag 88 and support the leading bag 88 in the receptacle portion 14 to receive waste, the user places the top portion of the leading bag 88 outwardly in overlying and covering relation with the top edge of the receptacle portion 14 and then places the peripheral ring 28 back on the receptacle portion 14. The top portion of the leading bag 88 that is lining the receptacle portion 14 of the waste receptacle 10 is pinched between the peripheral ring 28 and the top edge of the receptacle portion 14 to hold the bag open in the receptacle portion 14 in covering and lining relation with the waste receiving space 18.

Preferably, an upwardly facing access opening (not shown) is provided in the floor surface (formed by the cooperation of the interior bottom wall portions 38, 40 of the members 20, 22 in its operative position as aforesaid) of the receptacle portion of the waste receptacle 10 in its normal operative position to provide an opening between the bag storage space 16 and the waste receiving space 18. As can best be appreciated from FIG. 5A, the opening is formed by the arcuate curvature of adjacent, abutting (i.e., abutting in the normal operative position of the waste receptacle 10) edge portions 90, 92 on the interior wall portions 38, 40, respectively. Preferably this opening between the spaces 16, 18 is large enough to allow a new bag to pass out of the base 12 and enter into the receptacle portion 14 of the waste receptacle 10 while the waste receptacle 10 is still in its closed operative position. This is advantageous because it is within the scope of the invention to remove a full bag of waste and line the receptacle portion of the waste receptacle with a new bag while the waste receptacle 10 is still in its closed to position.

More particularly, when the bag lining the receptacle portion 14 is full of waste, the peripheral ring 28 is removed from the receptacle portion 14 and the top edges of the bag are brought together and tied or otherwise security together to close the bag and the bag is lifted out of the receptacle portion 14. Because the leading full bag of waste is still connected to the next bag on the roll, lifting the full bag of waste out of the receptacle portion 14 while the receptacle members 20, 22 are still in their closed position will cause the next bag on the roll to move outwardly of the base 12 and into the receptacle portion 14 as the full bag is pulled upwardly out of the receptacle 14 when the opening between the spaces 16, 18 is as described above. The user can then conveniently the tear off the next bag on the roll 84 from the full bag that is being removed and line the receptacle portion 14 with this new bag. Therefore, it can be understood that because the bags are disposed in a continuous roll 84, a new bag can be transferred from the storage space into the receptacle portion 14 by simply removing the full bag of waste in the receptacle without having to move the receptacle members 20, 22 to their open access position to replace the bag. The waste receptacle 10 can optionally be opened, however, to open the receptacle portion 14 to help, for example, remove the full bag of waste.

Alternatively, it is within the scope of the invention to construct the waste receptacle 10 such that the receptacle portion 14 is watertight while the receptacle members 20, 22 are in their closed normal operative position. When this construction is used, it is necessary to move the receptacle members 20, 22 apart each time a new bag is gotten from the bag storage space 16 in the base 12.

Figure 8:
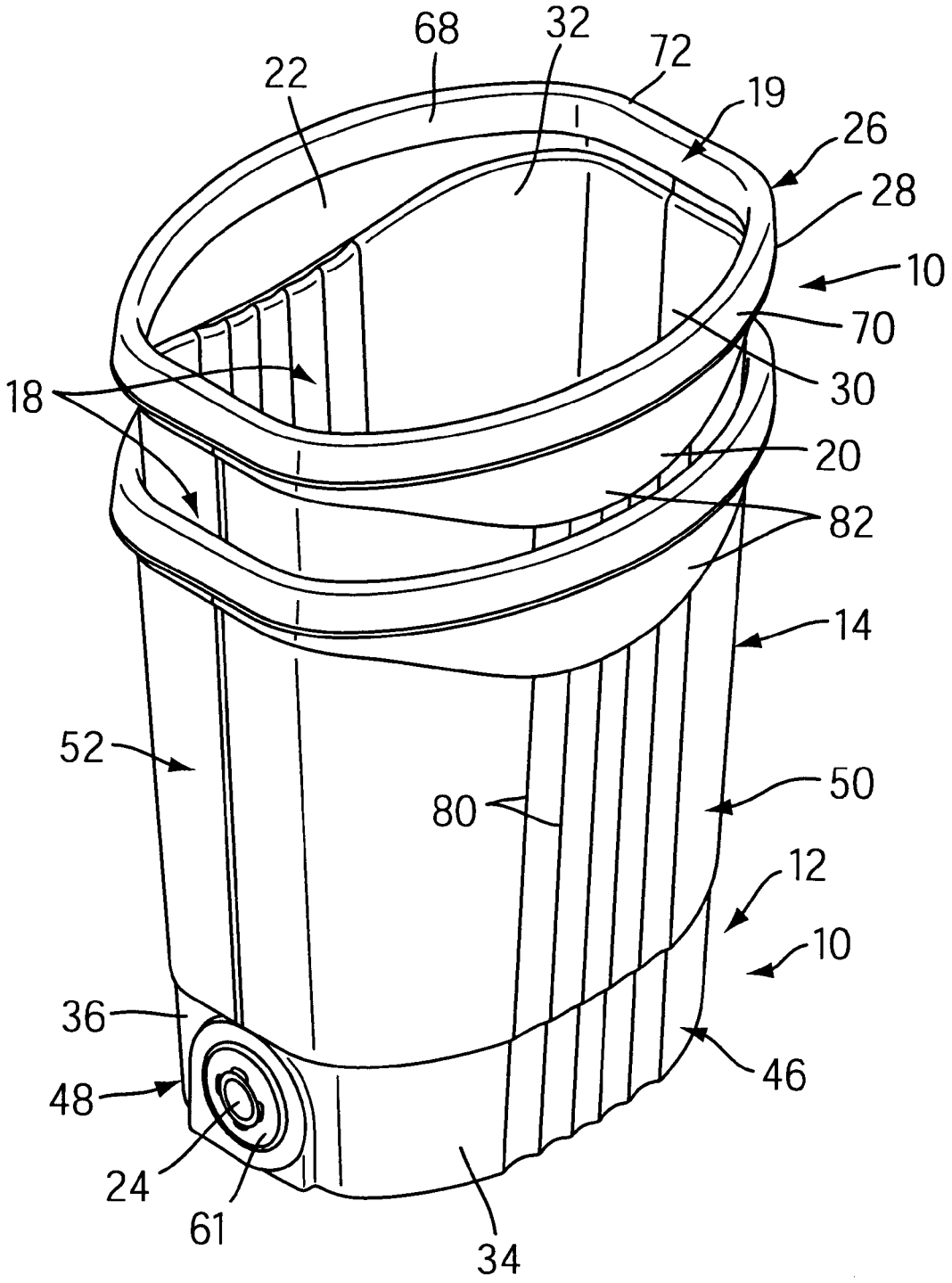
FIG. 8 is a perspective view of two nested waste receptacle assemblies.

FIGS. 2 and 8 show that the waste receptacle 10 is constructed and arranged to allow a plurality of waste receptacles 10 to be nested for easy storage and transport and for easy display in a retail setting. Specifically, each waste receptacle 10 is dimensioned to accommodate a second receptacle 10 therein to facilitate nesting. Thus, a plurality of waste receptacles 10 can be easily stacked and removed from the stack.

It is understood that the embodiment of the waste receptacle 10 described and shown herein is exemplary only and not intended to limit the scope of the present invention. For example, it is within the scope of the invention to configure the bag storage space 16 of the base 12 to store and dispense a supply of bags in any commercially available form and that it is not intended to limit the use of the waste receptacle to bags in continuous rolls. Bags supplied in boxes of individual bags could, for example, be stored and dispensed from the base.

The principles and preferred embodiments of the present invention have been described in the foregoing specification. However, the invention should not be construed as being limited to the particular embodiment, materials or methods of manufacturing that are described herein. Instead, the embodiments and methods described here should be regarded as illustrative and not restrictive. Variations and changes may be made by others without departing from the scope of the present invention as defined by the following claims.

What is claimed is:

1. A waste receptacle for use in conjunction with a roll of bags, said receptacle comprising:

a base constructed and arranged to support the receptacle in an upright position on a ground surface, said base having a bag storage space with a generally upwardly facing access opening, said bag storage space being constructed and arranged so that the roll of bags can be stored therein and accessed through said access opening;

a first receptacle member and a second receptacle member providing first and second peripheral wall portions, respectively, and first and second interior bottom wall portions, respectively, said first and second receptacle members being movable relative to one another to a normal, operative position wherein said first and second peripheral wall portions cooperate to provide said receptacle with a peripheral wall that extends generally upwardly from said base, and said first and second bottom interior wall portions cooperate to provide said receptacle with a bag supporting bottom wall that supports the bottom of a deployed bag within said receptacle, and, together with said first and second peripheral wall portions define a waste receiving space with an upper edge portion of said first and second peripheral wall portions defining a waste receiving opening that affords entry to said waste receiving space, said first and second receptacle members being movable from said operative position to a bag roll changing position wherein said first and second receptacle members are moved apart from one another so as to increase the size of the waste receiving opening so as to facilitate access to the bag receiving space through the upwardly facing access opening so that a new roll of flexible bags can be placed within the bag receiving space.

2. The receptacle of claim 1 wherein the base has first and second parts and the first part together with the first wall receptacle member form a single molded unit, and the second base part, together with the second wall receptacle member also form a single molded unit.

3. The waste receptacle of claim 1 wherein the first and second base parts are rotatably joined to each other.

4. The waste receptacle of claim 2 wherein the first and second base parts are joined via pivot end pieces.

5. The waste receptacle of claim 3 further comprising a releasable connector to secure the first wall member to the second wall member when they are in their normal, operative position.

6. The waste receptacle of claim 4 wherein the releasable connector is a peripheral ring which is removable thereby allowing the receptacle to move into the bag roll changing position.

7. The waste receptacle of claim 5 wherein the bag storage space contains a plurality of wedges dimensioned to accommodate a roll of interconnected bags so that when the supply of flexible bags is a roll of interconnected bags, the roll can be held in place by the wedges.

8. The waste receptacle of claim 6 wherein first and second receptacle wall members and first and second base parts have a plurality of wall-strengthening ribs.

9. The waste receptacle of claim 7, wherein the receptacle is dimensioned so that a plurality of said receptacles may be nested.

* * * * *